United States Patent [19]

Nakamura et al.

[11] 4,401,064

[45] Aug. 30, 1983

[54] ROCKER ARM FITTING STRUCTURE

[75] Inventors: Makoto Nakamura; Toshinari Hojima, both of Yokohama, Japan

[73] Assignee: Nissan Motor Company, Limited, Kanagawa, Japan

[21] Appl. No.: 234,585

[22] Filed: Feb. 13, 1981

[30] Foreign Application Priority Data

Feb. 14, 1980 [JP] Japan ..... 55-17532[U]

[51] Int. Cl.[3] ..... F01L 1/18

[52] U.S. Cl. ..... 123/90.39; 123/90.34; 123/90.44

[58] Field of Search ..... 123/90.33, 90.34, 90.39, 123/90.41, 90.44

[56] References Cited

U.S. PATENT DOCUMENTS

| | | | |
|---|---|---|---|
| 2,298,981 | 10/1942 | Smith | 123/90.39 |
| 2,982,273 | 5/1961 | Bergmann | 123/90.39 |
| 3,270,727 | 9/1966 | Nance | 123/90.39 |
| 3,628,513 | 12/1971 | Grosseav | 123/90.44 |
| 3,841,280 | 10/1974 | Lussier | 123/90.39 |

FOREIGN PATENT DOCUMENTS

| | | | |
|---|---|---|---|
| 529075 | 11/1940 | United Kingdom . | |
| 861598 | 2/1961 | United Kingdom . | |
| 2071208 | 9/1981 | United Kingdom | 123/90.39 |

*Primary Examiner*—Craig R. Feinberg
*Assistant Examiner*—W. R. Wolfe
*Attorney, Agent, or Firm*—Schwartz, Jeffery, Schwaab, Mack, Blumenthal & Koch

[57] ABSTRACT

In a mechanism for actuating valves of an internal combustion engine, in place of a conventional coil spring, a holding member formed at least partly like a leaf spring is used to hold resiliently a plurality of rocker arms in position. The holding member together with a rocker shaft is fixed to a support member, for example, by means of a bolt. A holding portion of the holding member can be formed at one end or both ends of a body portion of the holding member.

14 Claims, 11 Drawing Figures

ROCKER ARM FITTING STRUCTURE

BACKGROUND OF THE INVENTION

The present invention relates to a structure for fitting rocker arms in a mechanism for actuating valves of an internal combination engine.

In general, there are two valves for each cylinder: an intake or inlet valve and an exhaust valve. The intake valve opens during the intake stroke to admit the air-fuel mixture into the cylinder. The exhaust valve opens during the exhaust stroke to permit the burned gases to be exhausted from the cylinder. A mechanism for actuating the valves is related to a crankshaft so as to cause the valves to open and close with the proper relationship to the piston strokes. In the past, various types of valve-actuating mechanisms have been used for internal combustion engines. For example, a side-valve type, over-head valve type and over-head-camshaft type are well known.

FIG. 1 shows an example of conventional overhead camshaft type mechanism. A camshaft 2 is located near a cylinder head 1 and rotates in response to rotation of a crank shaft (not shown). A cam 3 is attached to the camshaft 2 in such a way that it can actuate rocker arms 4 so that the rocker arms move reciprocatively. The rocker arms 4 further actuate intake and exhaust valves 5, 6 so that the valves 5, 6 can open and close during reciprocating action of a piston (not shown).

As shown in FIG. 2, each rocker arm 4 has a boss portion 4' rotatably set onto a rocker shaft 7 which is mounted through a bracket 9 to a support member 8 fixed to the cylinder head 1. The bracket 9 is fixed to the support member 8, for instance, by means of a bolt.

In the illustrated conventional mechanism, two rocker shafts 7 are used. One rocker shaft 7*a* is equipped with a rocker arm 4*a* for the intake valve 5. The other rocker shaft 7*b* is equipped with another rocker arm 4*b* for the exhaust valve 6. The length of the bracket 9 in the axial direction of the rocker shaft is predetermined in such a manner that the rocker arms 4 can fittably contact both ends of the bracket 9 whereby the position of the rocker arms 4 can be properly located. In order to prevent the rocker arms 4 from moving out of position, also, the rocker shafts 7 are inserted into coil springs 10 between the rocker arms 4 and the brackets 9' adjacent thereto. Thus, the rocker arms 4 are pressed against the ends of the brackets 9'.

However, in such a conventional mechanism for securing the rocker arms 4, before the rocker shafts 7 are fixed to the support member 8, it is necessary to assemble in order the rocker arms 4, coil springs 10 and brackets 9 onto the rocker shafts 7. For such a reason, the assembling efficiency is extremely low. In addition, the brackets 9, coil springs 10 and others are required to be used for the purpose of holding the rocker arms 4 in position. As a result, many parts must be used and the production costs increase.

SUMMARY OF THE INVENTION

According to the present invention, a mechanism for actuating valves such as inlet and exhaust valves includes a special member for holding a plurality of rocker arms by its biasing force. Such a holding member is formed at least partly like a leaf spring and used in place of a conventional coil spring and other related parts in order to resiliently hold the rocker arms in position. The holding member has a holding portion at one end or each end of a body portion thereof. The body portion is to be fixed to a support or mounting member together with a rocker shaft, for instance, by means of a bolt.

Therefore, it is a main object of the present invention to provide a mechanism for actuating valves of an internal combustion engine in which rocker arms can be easily assembled.

A further object of the present invention is to provide a mechanism for actuating valves in which the number of required parts can be decreased.

BRIEF DESCRIPTION OF THE DRAWINGS

These and other objects, features and advantages of the present invention will become more apparent from the following description of preferred embodiments thereof when read in conjunction with the accompanying drawings in which:

FIG. 3 is a perspective view showing a holding member according to a preferred embodiment of the present invention;

FIG. 4 is a perspective view showing a part of a rocker shaft according to the present invention;

DETAILED DESCRIPTION OF THE PREFERRED EMBODIMENTS

Figure 1:
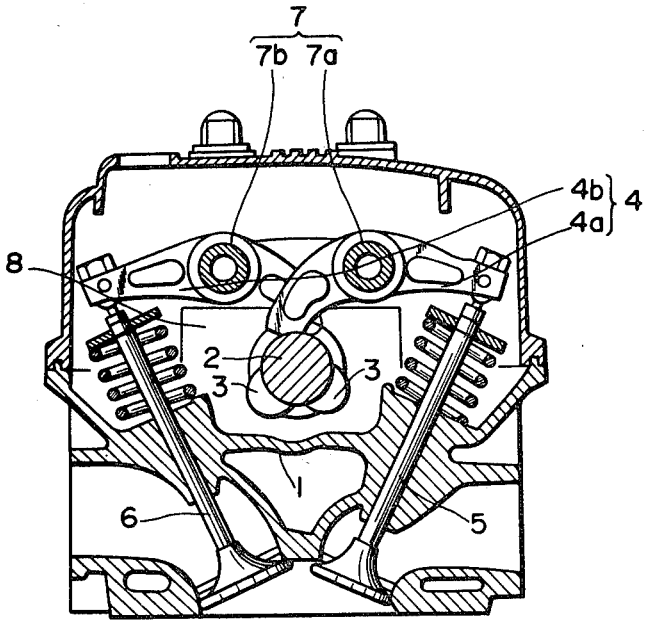
FIG. 1 PRIOR ART
FIG. 1 is a sectional view showing a conventional structure for securing rocker arms.
Figure 2:
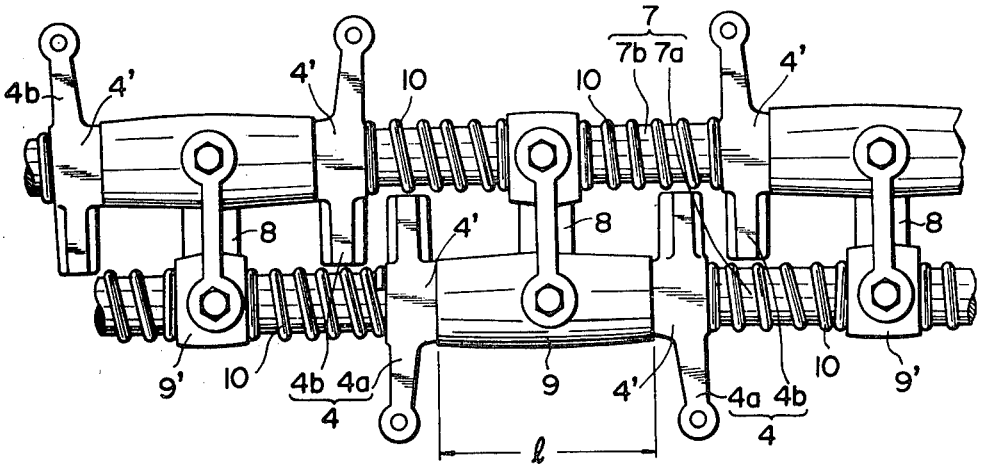
FIG. 2 PRIOR ART
FIG. 2 is a plane view showing the conventional structure shown in FIG. 1.

FIG. 3 shows a holding member 20 according to a preferred embodiment of the present invention. The holding member 20 is made of a spring material in a plate-shape. The holding member 20 includes a trapezoidal body portion 21 open at its bottom, a pair of holding portions 22 formed at both ends of the body portion 21 for holding resiliently the rocker arms 4 under pressure by the biasing force thereof, and a fitting or fixing portion 23 formed on the center of the body portion 21 in which a stepped portion 23*a* and a through hole 23*b* for a bolt are formed. The holding portions 22 may be formed by bending vertically both ends of the body portion 21. Each of holding portions 22 includes a pair of receiving pieces 22*a* for the rocker arms 4. The length l' between a pair of receiving pieces 22*a* is predetermined. Also, a pair of pressing pieces 22*b* are joined by way of a connecting piece 22*c* to the ends of the body portion 21 in such a way that the pressing pieces 22*b* can face toward the receiving pieces 22*a* in the axial direction of the rocker shafts 7. Each connecting piece 22*c* is formed substantially in a U-shape or the like to be arranged over the boss portion 4' of each rocker arm 4.

The distance l'' between the receiving pieces 22*a* and the pressing pieces 22*b* is slightly shorter than the thickness of the boss portion 4' of the rocker arm 4 so that the rocker arms can be held resiliently under pressure by means of the pressing pieces 22*b* and the receiving pieces 22*a*. The pressing piece 22*b* has at its underside portion a notched portion 22*b'* for the rocker shaft 7.

As shown in FIG. 4, the rocker shaft 7 has a notched portion 7*c* on which the stepped portion 23*a* of the fitting portion 23 of the holding member 20 is mounted, and a through hole 7*d* corresponding to the through hole 23*b* of the fitting portion 23. The reference 7' designates an oil passage formed in the axial direction of the rocker shaft 7.

Figure 5:
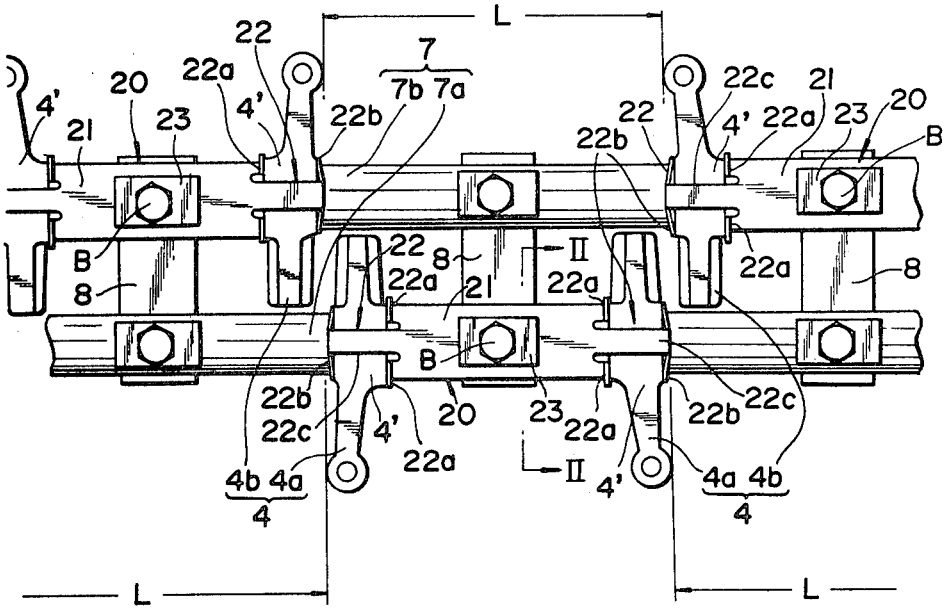
FIG. 5 is a plane view showing a structure for securing rocker arms according to the present invention.
Figure 6:
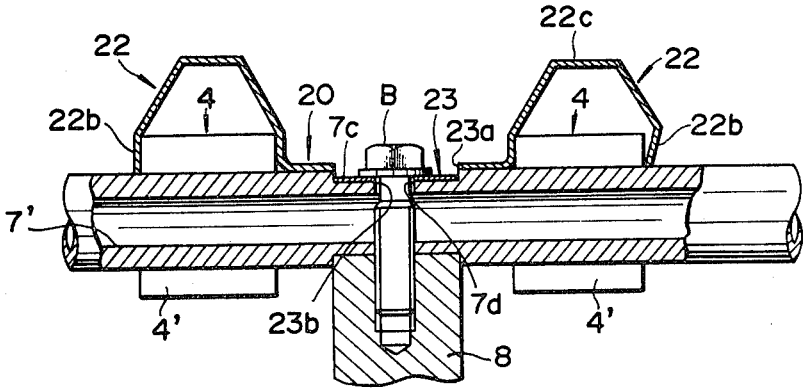
FIG. 6 shows a vertical section of the central portion of the structure shown in FIG. 5.
Figure 7:
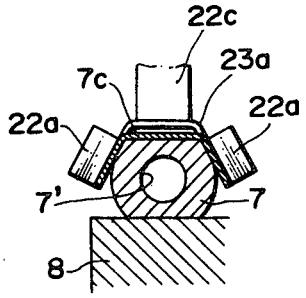
FIG. 7 is a sectional view taken along the line II—II in FIG. 5.

FIGS. 5 through 7 illustrate how the rocker arms 4 are assembled with other related parts. First of all, the rocker shafts 7 are rotatably inserted into the rocker arms 4. A pair of rocker arms 4 are set to be resiliently held by the holding portions 22 of the holding member 20 under pressure. Next, the body portion 21 of the holding member 20 is set on the rocker shaft 7. The fitting portion 23 is mounted on the notched portion 7*c* of the rocker shaft 7 so that they are located in position. The bolt B is inserted into both through-holes 23*b*, 7*b* and then screwed to the support or mounting member 8 as best shown in FIG. 6.

Although in the shown embodiment the holding member 20 is manufactured by a press method to be a plate-like member made of a spring or elastic material as a whole, the present invention is not limited to such a mode. For example, the body portion 21, the receiving piece 22*a* and the pressing piece 22*b* can be separately formed of a rigid material in a plate-shape and joined with each other by means of the connecting piece 22*c* made of a resilient or elastic material.

When the connecting piece 22*c* is formed like a leaf spring, its characteristic frequency can be higher than that of the conventional coil spring 10 so that the rocker arms 4 can be prevented from breaking due to the engine resonance.

Figure 8:
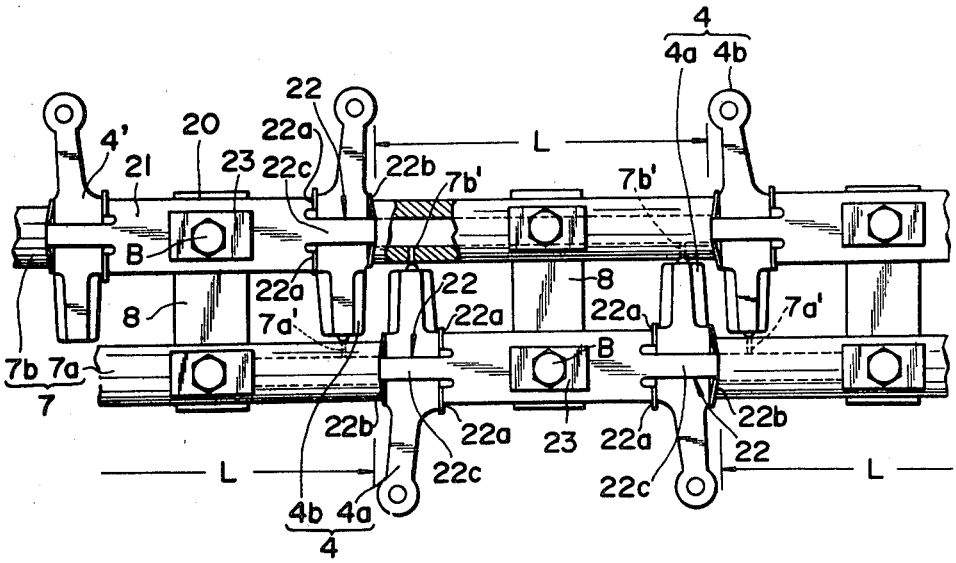
FIG. 8 is a plane view showing a further embodiment of the present invention.
Figure 9:
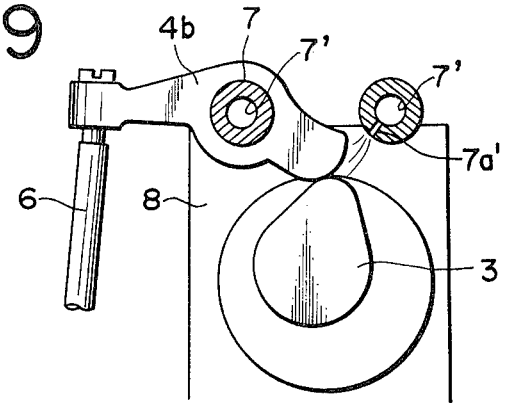
FIG. 9 shows a lateral section of an essential portion of the embodiment shown in FIG. 8.

As the coil spring 10 is omitted, according to the present invention, no member covers partly the rocker shafts 7 within the ranges designated by the reference L. As shown in FIGS. 8 and 9, the holding member 20 is arranged in such a manner that the front end portion of the rocker arms 4*b* attached onto one rocker shaft 7*b* is positioned near the other rocker shaft 7*a*, and a small opening 7*a'* is formed in the other rocker shaft 7 to be connected with the oil passage 7' within the ranges L of the other rocker shaft 7*a*. The small opening 7*a'* faces a portion of the rocker arm 4*b* which the cam 3 engages, so that the lubricating oil sprayed through the small opening 7*a'* can lubricate the cam face of the cam 3. By doing so, no opening for lubricating oil need be formed in the cam 3 and the rocker arms 4. As a result, the strength of the cam 3 and the rocker arms 4 can be remarkably increased.

Figure 10:
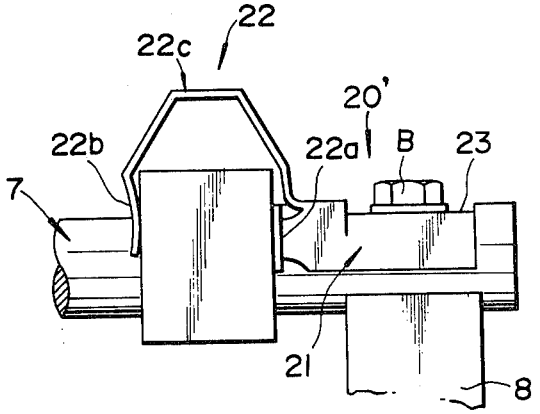
FIG. 10 is a schematic view showing a holding member according to another embodiment of the present invention.
Figure 11:
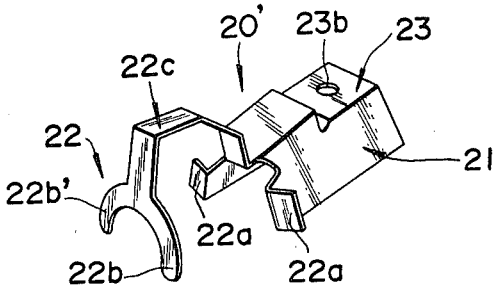
FIG. 11 is a perspective view of the holding member shown in FIG. 10.

FIGS. 10 and 11 show a holding member according to a further embodiment of the present invention. A holding member 20' is substantially the same as a half part of the holding member 20 shown in FIG. 3. That is, a holding portion 22 is formed only at one end of the body portion 21. Like members or portions are designated by the same references in FIGS. 3 and 11. Such a type of holding member 20' is suitable for holding a rocker arm 4 placed at an end of the rocker shaft 7.

As can be seen from the foregoing, according to the present invention, only the rocker arms can be attached to the rocker shafts when they are assembled at a first stage. Thus, by adjusting the position of the holding member, the rocker arms can be precisely positioned. It results in the remarkable improvement of the assembling efficiency. Also, as the number of parts to be assembled can be decreased, the production costs can be decreased.

What is claimed is:

1. A mechanism for actuating a valve of an internal combustion engine, comprising:
- a rocker shaft;
- a rocker arm fitted to the rocker shaft;
- a holding member at least partly made of an elastic material formed in a plate-shape for resiliently holding the rocker arm in position on said shaft;
- the holding member including:
- a pressing piece for biasing the rocker arm along the rocker shaft; and
- a receiving piece facing the pressing piece for receiving the rocker arm so that the rocker arm can be positioned between the pressing and receiving piece.

2. A mechanism as recited in claim 1, wherein the holding member includes a body portion formed substantially in a trapezoidal shape and fixed to the rocker shaft.

3. A mechanism as recited in claim 1, wherein the holding member includes a body portion fixed to the rocker shaft and a pair of holding portions formed at both ends of the body portion for holding the rocker arms by the biasing force thereof.

4. A mechanism as recited in claim 1, further comprising
- another rocker shaft;
- another rocker arm fitted to said other rocker shaft;
- a cam positioned for contacting a portion of said other rocker arm for actuating same; and
- said one rocker shaft having means for feeding a lubricating oil to a region of contact of said cam and said portion of said other rocker arm.

5. A mechanism as recited in claim 4, wherein the feeding means includes a long hole formed in said one rocker shaft in the axial direction thereof and a small opening formed therein to be connected with the long hole in such a manner that the lubricating oil can be sprayed through the small opening onto said region of contact.

6. A mechanism for actuating valves of an internal combustion engine, comprising:
- a rocker shaft;
- a plurality of rocker arms fitted to the rocker shaft;
- a holding member at least partly made of an elastic material formed in a plate-shape for resiliently holding the rocker arms in position; and
- a support member for fixing the holding member together with the rocker shaft thereto,
- the holding member including:
- a pair of pressing pieces for biasing the rocker arms along the rocker shaft; and
- a pair of receiving pieces facing the pressing pieces for receiving the rocker arms so that the rocker arms can be positioned between the pressing and receiving pieces.

7. A mechanism as claimed in claim 6, wherein the holding member further includes:
- a body portion fixed to the rocker shaft; and
- a connecting portion formed like a leaf spring for connecting the pressing portions with an end of the body portion, the connecting portion being formed in such a shape as to be arranged over a portion of each rocker arm.

8. A mechanism for actuating valves of an internal combustion engine, comprising:

a rocker shaft;

a plurality of rocker arms fitted to the rocker shaft;

a holding member at least partly made of an elastic material formed in a plate-shape for resiliently holding the rocker arms in position; and a support member for fixing the holding member together with the rocker shaft thereto, wherein the rocker shaft has a stepped portion, and the holding member has a stepped portion corresponding to the stepped portion of the rocker shaft in such a manner that the stepped portion of the holding member can be fitted onto the stepped portion of the rocker shaft.

9. A mechanism as defined in claim 8, wherein the stepped portion of the holding member has a hole, and the stepped portion of the rocker shaft has a hole so that a common bolt can be screwed into the holes thereby fixing the holding member and the rocker shaft together to the support member.

10. A mechanism as defined in claims 6, 8 or 1, wherein the holding member is formed like a leaf spring as an integral unit.

11. A mechanism as defined in claims 6 or 8, wherein the holding member includes a body portion formed substantially in a trapezoidal shape and fixed to the rocker shaft.

12. A mechanism as defined in claims 6 or 8, wherein the holding member includes a body portion fixed to the rocker shaft and a pair of holding portions formed at both ends of the body portion for holding the rocker arms by the biasing force thereof.

13. A mechanism as defined in claims 6, 7, 8 or 9, further comprising another rocker shaft;

another plurality of rocker arms fitted to said other rocker shaft;

a cam positioned for contacting a portion of one of said another plurality of rocker arms for actuating same; and said one rocker shaft having means for feeding lubricating oil to a region of contact of said cam and said portion of said one rocker arm of said another plurality of rocker arms.

14. A mechanism as defined in claim 13, wherein the feeding means includes a long hole formed in said one rocker shaft in the axial direction thereof and a small opening formed therein to be connected with the long hole in such a manner that the lubricating oil can be sprayed through the small opening onto said region of contact.

* * * * *